US006942561B2

(12) United States Patent
Mota et al.

(10) Patent No.: US 6,942,561 B2
(45) Date of Patent: Sep. 13, 2005

(54) REINFORCED ABRASIVE WHEELS

(75) Inventors: Jose Roberto Mota, São Paulo (BR); Jean-Marie Albrecht, Amboise (FR)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 10/816,053

(22) Filed: Apr. 1, 2004

(65) Prior Publication Data

US 2004/0185761 A1 Sep. 23, 2004

Related U.S. Application Data

(62) Division of application No. 10/260,014, filed on Mar. 20, 2003, now Pat. No. 6,749,496, which is a continuation of application No. 09/364,235, filed on Jul. 29, 1999, now abandoned.

(51) Int. Cl.[7] ..... B23F 21/03

(52) U.S. Cl. ..... 451/541; 451/548; 451/546

(58) Field of Search ..... 451/540, 541, 451/542, 546, 548, 508, 513, 514

(56) References Cited

U.S. PATENT DOCUMENTS

| | | | |
|---|---|---|---|
| 1,944,489 | A | 1/1934 | Bockshe |
| 2,540,793 | A | 2/1951 | Metzger |
| 2,726,493 | A | 12/1955 | Young et al. |
| 3,040,485 | A | 6/1962 | Tocci-Guilbert |

(Continued)

FOREIGN PATENT DOCUMENTS

| | | |
|---|---|---|
| DE | 30 03 666 A1 | 2/1980 |
| DE | 38 19 199 A1 | 6/1988 |
| DE | 29908618 U1 | 7/1999 |
| JP | 11028668 | 2/1999 |
| KR | 8 800 144 | 3/1988 |
| WO | WO 9105636 | 5/1991 |
| WO | WO 92/00163 | 1/1992 |

OTHER PUBLICATIONS

Safety in the Use of Grinding Wheels—General Applications by Federation of the European Producers of Abrasives, Feb. 15, 1999.

Saint–Gobain Abrasives Brochure for Norton NORZON® III Foundry Depressed Center Wheels, Sep., 2001.

*Primary Examiner*—Dung Van Nguyen
(74) *Attorney, Agent, or Firm*—Hamilton, Brooks, Smith & Reynolds, P.C.

(57) ABSTRACT

In a depressed-center abrasive wheel assembly a reinforcement layer of polygonal shape is located between a front face of the abrasive wheel and a front flange. The reinforcement layer is dimensioned to entirely cover the depressed center portion of the wheel. An example of polygonal reinforcement layer has a hexagonal shape and is made of fiberglass cloth. A polygonal shape reinforcement layer can also be employed between the front flange and the front face in an abrasive flat wheel assembly that employs a wheel without internal reinforcement.

7 Claims, 5 Drawing Sheets

U.S. PATENT DOCUMENTS

| | | | | |
|---|---|---|---|---|
| 3,136,100 | A | | 6/1964 | Robertson, Jr. |
| 3,146,560 | A | | 9/1964 | Hurst |
| 3,262,230 | A | | 7/1966 | Seymour et al. |
| 3,353,306 | A | | 11/1967 | Seymour et al. |
| 3,477,180 | A | | 11/1969 | Robertson, Jr. |
| 3,528,203 | A | | 9/1970 | Franklin et al. |
| 3,685,215 | A | | 8/1972 | Bates |
| 3,828,485 | A | | 8/1974 | McClure |
| 3,838,543 | A | | 10/1974 | Lakhani |
| 3,859,761 | A | | 1/1975 | Lutz |
| 3,939,612 | A | | 2/1976 | Peterson |
| 4,015,371 | A | | 4/1977 | Grayston |
| 4,062,153 | A | | 12/1977 | Malm |
| 4,069,622 | A | | 1/1978 | Swarovski |
| 4,164,098 | A | | 8/1979 | Akita |
| 4,230,461 | A | | 10/1980 | Sandman et al. |
| 4,240,230 | A | | 12/1980 | Ferrantini |
| 4,350,497 | A | | 9/1982 | Ogman |
| 4,541,205 | A | | 9/1985 | Patrello |
| 4,729,193 | A | | 3/1988 | Gant et al. |
| 4,774,788 | A | | 10/1988 | Shacham et al. |
| 5,031,361 | A | | 7/1991 | MacKay, Jr. |
| 5,287,659 | A | | 2/1994 | Timmons et al. |
| 5,343,656 | A | * | 9/1994 | Loos et al. ..... 451/540 |
| 5,431,596 | A | | 7/1995 | Akita et al. |
| 5,558,738 | A | | 9/1996 | Rector |
| 5,695,394 | A | | 12/1997 | Buffat et al. |
| 5,895,317 | A | | 4/1999 | Timm |
| 5,913,994 | A | | 6/1999 | Avril et al. |
| 6,749,496 | B2 | * | 6/2004 | Mota et al. ..... 451/546 |

* cited by examiner

REINFORCED ABRASIVE WHEELS

RELATED APPLICATIONS

This application is a divisional of U.S. application Ser. No. 10/260,014, filed Mar. 20, 2003 (now U.S. Pat. No. 6,749,496), which is a continuation of U.S. application Ser. No. 09/364,235, filed Jul. 29, 1999, now abandoned. The entire teachings of the above application are incorporated herein by reference.

BACKGROUND OF THE INVENTION

Abrasive wheels are generally formed by bonding together abrasive grains or particles with a bonding material, typically a resin. Such wheels are employed in grinding operations. For example, "thin" wheels are used in cutoff and snagging operations and may be used without external cooling. Thin abrasive wheels may have no reinforcement or they may be fabric or filament reinforced. Thin abrasive wheels can have full or partial (zone) reinforcement.

Both flat and depressed center abrasive wheels are available. Flat (Type 1) wheels typically are held between two flanges of equal size and mounted on the rotating spindle of a machine.

Depressed center abrasive wheels are characterized by a displacement of the central portion (or the hub) of the wheel with respect to the periphery of the wheel. One face of the wheel has a depressed central portion, while the other face exhibits a raised center. Classified as Type 27 or Type 28, these wheels can be used for cutting or grinding.

Generally, depressed center wheels are mounted on angle machines between two flanges: a rear flange, facing the raised central portion or the raised hub of the wheel, and a front flange. While the front flange fits entirely within the depressed center, the back flange typically covers the raised center and extends beyond it onto the flat portion of the wheel.

Hub assemblies hold the wheel between the two flanges for mounting it onto the spindle of a grinding machine. Often, a hub assembly has two parts, each generally corresponding to the rear and front flange, and are held together by a threaded nut. In another hub assembly design, the two pieces are bonded to the wheel by using an epoxy resin. A one-piece hub assembly which is integrally molded to the wheel has also been developed. In some cases, the mounting assemblies are sufficiently inexpensive to allow discarding the mounting hub along with the worn-out wheel.

Since abrasive wheels are operated at high rotational speeds and used against hard materials such as steel and other metals, masonry or concrete, they must be capable of withstanding these conditions and of operating safely. Furthermore, since they wear out and need to be replaced, keeping their cost of manufacturing low is also important. Because maximum stress occurs at or near the center of the hub, the hub portion of the wheel usually contains additional reinforcing material, typically one or more circles of fiberglass cloth extending approximately to the juncture of the hub and the grinding face of the wheel. Typically, about one-third of the fiberglass cloth is wasted in cutting these circles.

Therefore, a need exists for safe abrasive wheel assemblies and for lowering their manufacturing costs.

SUMMARY OF THE INVENTION

The present invention relates to an abrasive wheel assembly including a wheel having a rear face and a front face. The assembly also includes a rear flange at the rear face of the wheel and a front flange at the front face of the wheel. Between the front face of the wheel and the front flange, there is a reinforcement layer having a polygonal shape such as a hexagon. The largest diameter of the reinforcement layer is no greater than 75% of the outer diameter of the wheel.

The present invention also relates to a depressed center abrasive wheel assembly. The assembly comprises an abrasive wheel having two faces. The rear face includes a raised hub and a flat rear wheel region while the front face includes a depressed center and a flat front wheel region. The assembly further comprises a rear flange covering the raised center and a front flange positioned at the depressed center. Between the front face of the wheel and the front flange, there is a reinforcement layer having the shape of a polygon. The largest diameter of the polygonal reinforcement layer is no greater than 75% of the outer diameter of the wheel.

The present invention is also related to an abrasive wheel assembly comprising a flat wheel which is not internally reinforced and has a rear face and a front face. The assembly also includes a rear flange at the rear face of the wheel and a front flange at the front face of the wheel. Between the front face of the wheel and the front flange, there is a reinforcement layer having the shape of a triangle, square, pentagon, hexagon, octagon or other polygon. The largest diameter of the reinforcement layer is no greater than 75% of the outer diameter of the wheel. In one embodiment, the wheel is a flat wheel.

The present invention is also related to a reinforced abrasive flat wheel assembly comprising a wheel which is internally reinforced and has a rear face and a front face. The assembly also includes a rear flange at the rear face of the wheel and a front flange at the front face of the wheel. Between the front face of the wheel and the front flange, there is a reinforcement layer having the shape of a pentagon, hexagon or octagon. The largest diameter of the reinforcement layer is no greater than 75% of the outer diameter of the wheel.

This invention has several advantages. For example, the reinforcement layer provides additional strength to the wheel assembly. The layer also forms a pad between the front flange and the depressed center of the wheel, thereby minimizing any empty space that might exist between the wheel front face and the front flange. Since the layer is 75% or less of the outer wheel diameter, savings in layer materials are obtained. Also, since the layer is typically cut from cloth, shapes such as, for example, hexagons provide significant reductions in the waste of cloth material, thereby significantly lowering the manufacturing cost of wheel assemblies.

DETAILED DESCRIPTION OF THE INVENTION

The features and other details of the invention, either as steps of the invention or as combination of parts of the invention, will now be more particularly described with reference to the accompanying drawings and pointed out in the claims. The same numeral present in different figures represents the same item. It will be understood that the particular embodiments of the invention are shown by way of illustration and not as limitations of the invention. The principle feature of this invention may be employed in various embodiments without departing from the scope of the invention.

Figure 1:
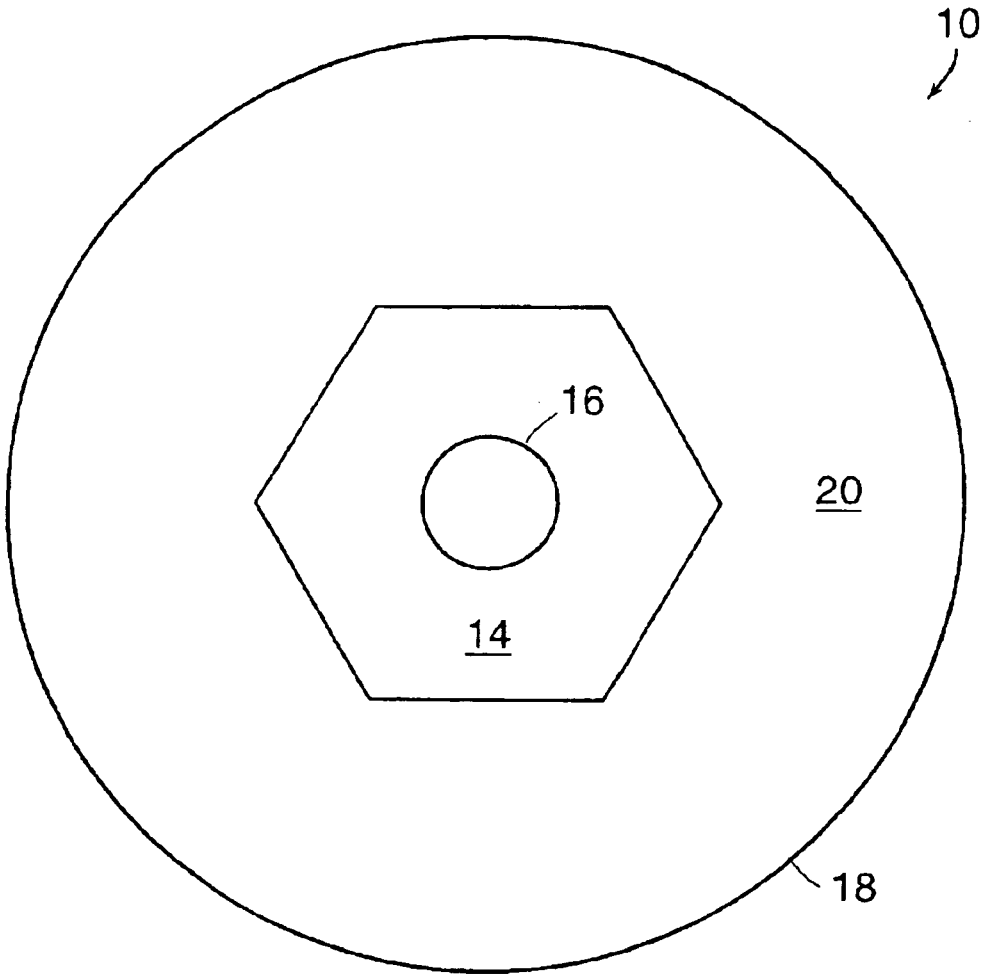
FIG. 1 is a plan view of a wheel and a reinforcement layer of one embodiment of the invention.

FIG. 1 is a plan view of one embodiment of the invention. As shown, abrasive wheel 10 includes front face 20. Abrasive wheel 10 can be of a flat or depressed-center type. Reinforcement layer 14 overlays front face 20 of abrasive wheel 10. Reinforcement layer 14 is concentric with abrasive wheel 10. Both abrasive wheel 10 and reinforcement layer 14 have orifice or arbor hole 16 which generally allows mounting abrasive wheel 10 and reinforcement layer 14 onto the rotating spindle of a machine.

Reinforcement layer 14 has the shape of a hexagon. When cut from a material such as, for example, cloth, the hexagonal shape minimizes wasted material. Other polygonal shapes can also be employed. Among them, shapes such as triangles and squares also minimize wasted material when cut from cloth. A hexagonal shape is preferred.

Other polygons such as pentagons, octagons, can be employed. Because a small amount of fabric waste occurs while cutting polygons such as, for example, pentagons or octagons, these shapes are less desirable than the shapes discussed above, but are more desirable than circular shapes.

The reinforcement layer has a polygon largest diameter and a polygon smallest diameter. The largest polygon diameter is the diameter of a circle circumscribing the polygon, while the smallest diameter is the diameter of a circle inscribed or circumscribed within the polygon.

As seen in FIG. 1, reinforcement layer 14 only partially covers front face 20 of abrasive wheel 10, and is dimensioned so that its largest diameter is smaller than outer wheel diameter 18. In one embodiment of the invention, reinforcement layer 14 has a polygon largest diameter no greater than about 75% of outer wheel diameter 18. In another embodiment, the polygon largest diameter is no greater than about 66% of outer wheel diameter 18. In yet another embodiment, reinforcement layer 14 has a polygon smallest diameter that is at least about 50% of outer wheel diameter 18. In still another embodiment of the invention, the polygon smallest diameter is at least about 25% of outer wheel diameter 18.

Reinforcement layer 14 typically is in the form of a pad or mat. In one embodiment, reinforcement layer 14 is fabricated from cloth or from other suitable materials. In a preferred embodiment, reinforcement layer 14 includes fiberglass cloth. One or more polygonal reinforcement layers can be employed in the abrasive wheel assembly of the invention.

The polygonal reinforcement layer of the invention is external to the body of the wheel and is applied onto front surface 20 (grinding face surface) of abrasive wheel 10. If desired, a second reinforcement layer, also external to the body of the wheel, can be applied between a rear face of abrasive wheel 10 and a rear flange. This second reinforcement layer, at the rear face of the wheel, can be circular or can have one of the polygonal shapes discussed above. It can be of a suitable material, which can be the same or different from the material used to fabricate reinforcement layer 14 between front face 20 of abrasive wheel 10 and a front flange (not shown).

Optionally, the body of abrasive wheel 10 itself can contain one or more discs of fiber reinforcement which are embedded within the wheel. Herein, such wheels are referred to as reinforced wheels, internally reinforced wheels or wheels having internal reinforcement. Methods for incorporating internal reinforcements within the body of abrasive wheels are known in the art. For example, embedding cloth discs within the body of the wheel is disclosed in U.S. Pat. No. 3,838,543, issued on Oct. 1, 1974 to H. G. Lakhani, the contents of which are incorporated by reference herein in their entirety.

One embodiment of the invention is related to depressed-center abrasive wheels, which are also known as raised hub (or raised center) wheels. This embodiment is illustrated in FIGS. 2 and 3.

Figure 2:
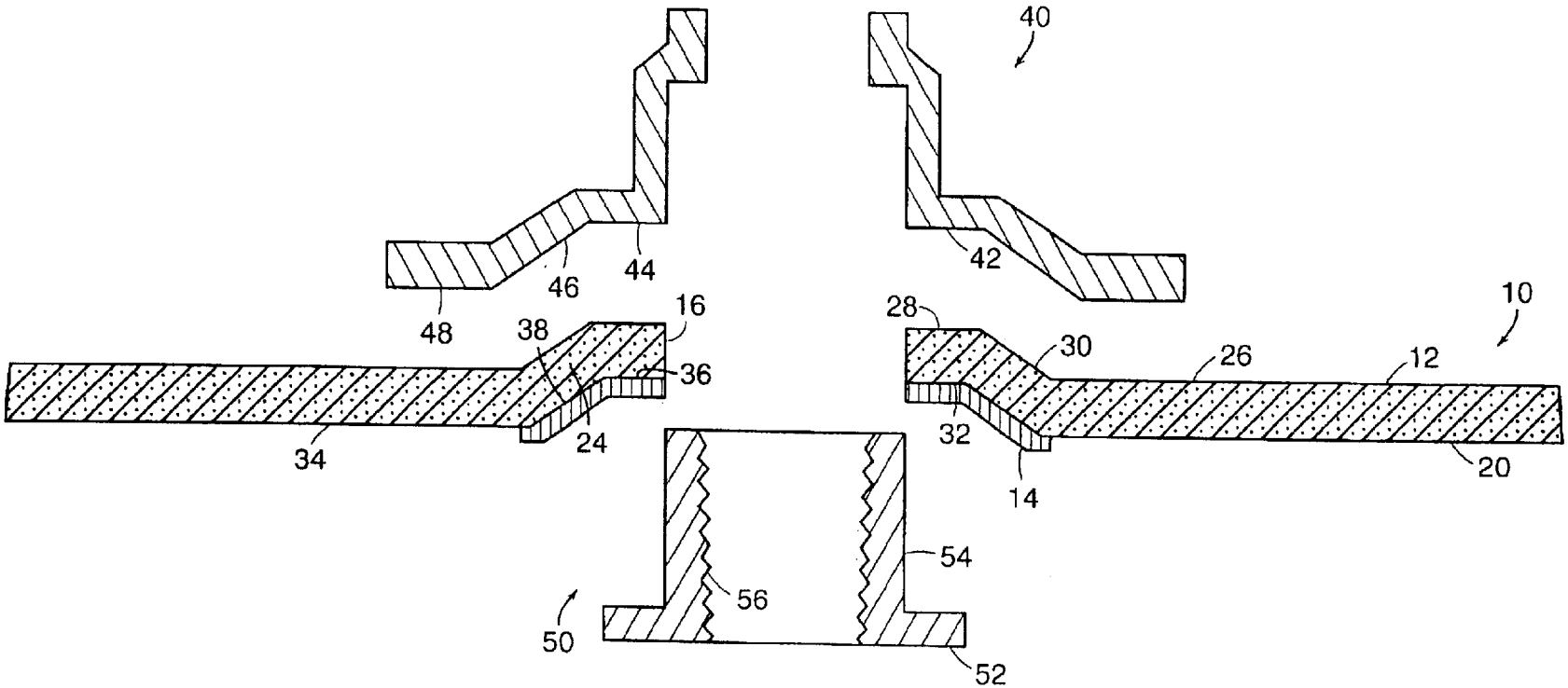
FIG. 2 is a cross-sectional view of a rear flange, abrasive wheel and front flange of an embodiment of the invention.
Figure 3:
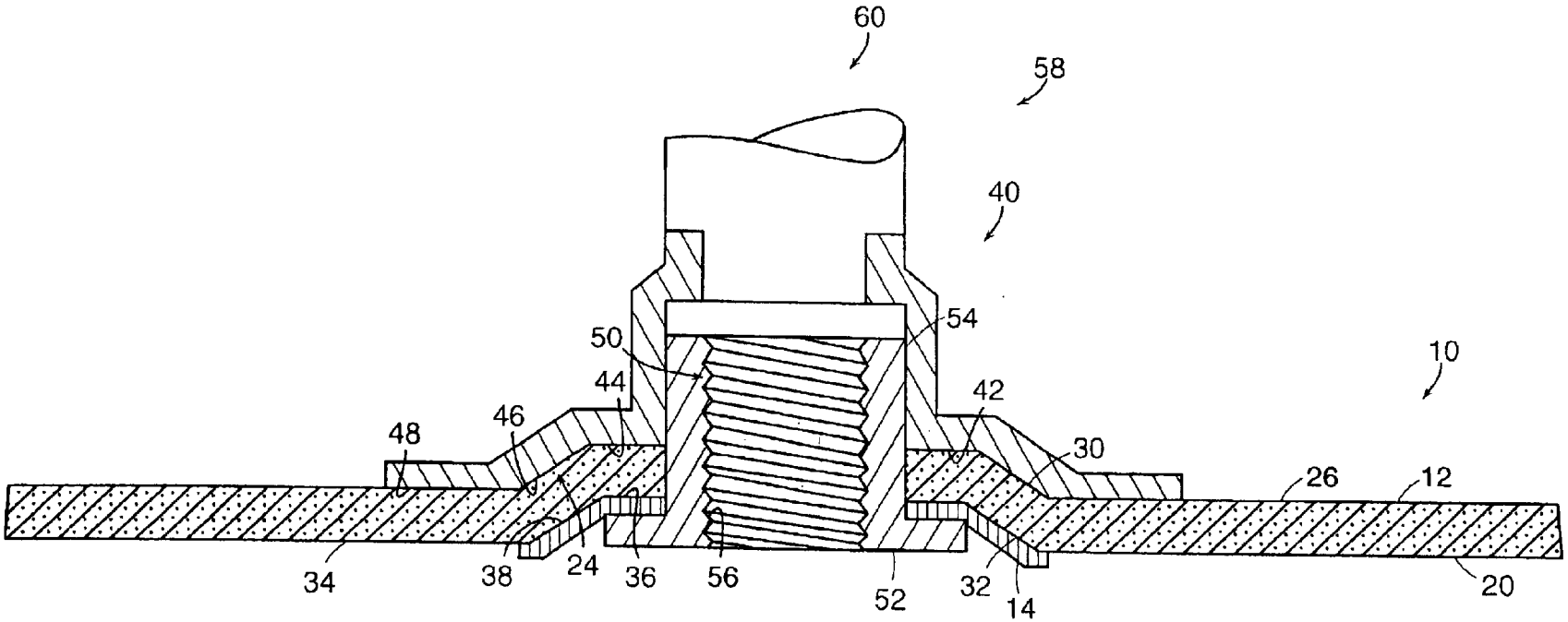
FIG. 3 is a cross sectional view of the embodiment represented in FIG. 2 and showing an assembled wheel arrangement.

FIG. 2 is a cross sectional view of an abrasive wheel 10, rear flange 40 and front flanges 50. Abrasive wheel 10 is a depressed-center abrasive wheel and, optionally, can be internally reinforced. Abrasive wheel 10 includes rear face 12 and front face 20. Rear face 12 includes raised hub 24 and outer flat rear wheel region 26. Raised hub 24 further includes a raised hub flat surface 28 and raised hub tapering surface 30 which tapers outwardly to outer flat rear wheel region 26.

Front face 20 includes depressed center 32 and outer flat front wheel region 34. Depressed center 32 further includes depressed center flat surface 36 and a depressed center tapering surface 38 which tapers outwardly to outer flat front wheel region 34. Typically, raised hub flat surface 28 is parallel to depressed center flat surface 36 and raised hub tapering surface 30 is parallel to depressed center tapering surface 38.

Reinforcement layer 14 is at depressed center 32. Reinforcement layer 14 can have any polygonal shape. Preferred shapes include, but are not limited to triangles, squares, pentagons, hexagons and octagons. In one embodiment of the invention, reinforcement layer 14 is cut from fiberglass cloth material. Optionally, a second reinforcement layer (not shown) can be employed at raised hub 24.

Rear flange 40 generally conforms to raised hub 24 and partially extends onto outer flat rear wheel region 26. Accordingly, rear flange 40 has a recessed region 42 corresponding to raised hub 24 and is dimensioned to fit over raised hub 24. Recessed region 42 has first rear flange flat portion 44, designed to fit over raised hub flat surface 28, and rear flange tapering portion 46, designed to fit over raised hub tapering surface 30. Rear flange 40 further includes second rear flange flat portion 48 partially extending onto outer flat rear wheel region 26.

Front flange 50 includes flat member 52 and front flange body 54. Front flange 50 fits entirely within depressed center 32. Front flange body 54 includes threads 56 for engaging onto a machine rotating spindle (not shown).

FIG. 3 is a cross sectional view of depressed-center wheel assembly 58 and reinforcement layer 14, which is positioned between front face 20 of abrasive wheel 10 and front flange 50.

Means 60, for holding together rear flange 40, abrasive wheel 10 and front flange 50 and for mounting them onto a machine rotating spindle, are known in the art, such as is described in U.S. Pat. No. 3,136,100 issued to Robertson on Jun. 9, 1964, the teachings of which are incorporated herein by reference in their entirety.

It is further understood that rear flange 40 and front flange 50 can be manufactured in one piece or from several pieces, as is known in the art. The materials used to make abrasive wheel 10, rear flange 40 and front flange 50 are also known in the art.

For angle grinding and hand-held grinding, depressed-center 32 preferably is entirely covered by reinforcement layer 14. In other words, depressed-center flat surface 36 and depressed-center tapering surface 38 are both covered with reinforcement material. In one embodiment of the invention, tips of the polygonal reinforcement layer lie on outer flat front wheel region 34. In another embodiment, reinforcement layer 14 has a polygon largest diameter which is 75% or less than the abrasive wheel 10 diameter. In still another embodiment of the invention, the polygon largest diameter is 66% or less of the abrasive wheel 10 diameter.

As discussed above, the reinforcement layer also has a polygon smallest diameter. In one embodiment of the invention, the polygon smallest diameter is more than 50% of the abrasive wheel 10 diameter. In another embodiment, the polygon smallest dimension is 25% or more of the abrasive wheel 10 diameter.

If the abrasive wheel 10 is flat machine-mounted, the dimensions of the reinforcement layer 14 can be smaller. For example, reinforcement layer 14 can cover only flat surface 36 of depressed center 32 of a machine-mounted wheel used for flat grinding. In one embodiment of the invention, reinforcement layer 14 covers about 5% of the abrasive wheel 10 diameter. In another embodiment of the invention, reinforcement layer 14 employed in such operations covers about 5% to about 20% of abrasive wheel 10 diameter. In still another embodiment of the invention, reinforcement layer 14 has a polygon smallest diameter between about 5% and about 25% of abrasive wheel 10 diameter.

Without being held to any particular mechanical explanation of the invention, it is believed that angle grinding using depressed center wheels creates tangential forces that shift the maximum stress away from the hub center. In such cases, it is desirable to provide reinforcement for the entire depressed center. In wheels in which tangential forces do not shift the maximum stress away from the center of the wheel, the dimensions of the layer can be further reduced and reinforcement may be provided only near the arbor. As used herein, the arbor is the central axis of the abrasive wheel assembly such as, for example, the rotating spindle on which the abrasive wheel assembly is mounted.

The invention is also related to hexagonal and other polygonal reinforcement layers used between the front face and the front flange in flat wheel assemblies. Examples of flat wheels include wheels of Type 1 configuration, such as, for example, Gemini® cut-off wheels available from Norton Company, Worcester, Mass. Their size can range, for example, from about 0.75 inches to 72 inches in diameter and they typically are 0.25 inches thick or less.

Figure 4:
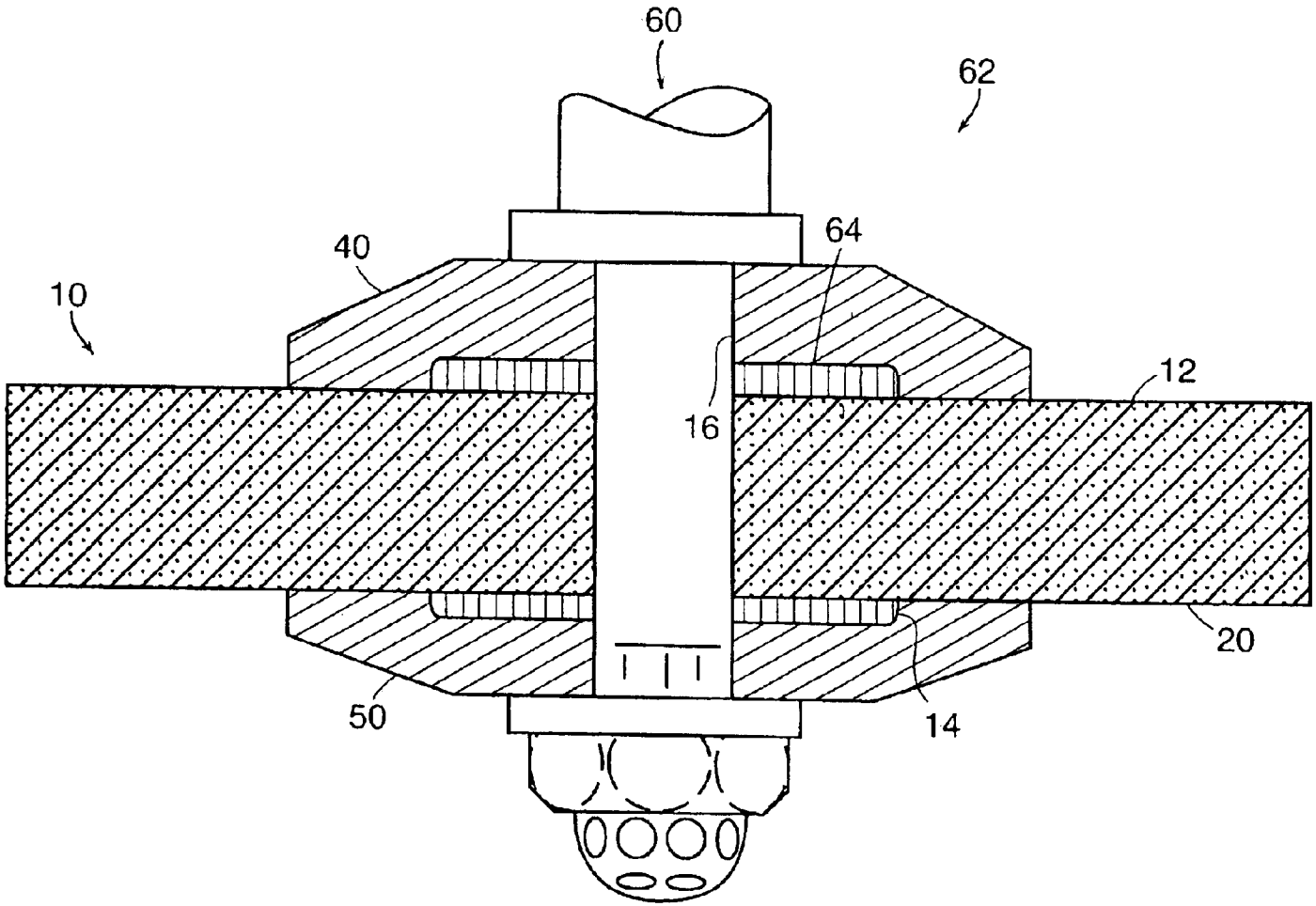
FIG. 4 is a cross sectional view of one embodiment of the invention.

FIG. 4 is a cross sectional view of flat wheel assembly 62 and reinforcement layer 14, which is positioned between front flange 50 and front face 20 of abrasive wheel 10. Optional second reinforcement layer 64 is positioned between rear flange 40 and rear face 12 of abrasive wheel 10. Second reinforcement layer 64 can have a circular or non-circular shape. It can be, for example, a hexagon or another polygon. It can include any suitable reinforcement material typically used in conjunction with abrasive wheels, such as, for example, fiberglass cloth.

Figure 5:
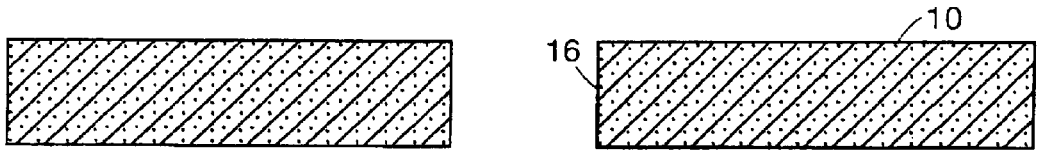
FIG. 5 is a cross sectional view of an unreinforced flat wheel.

Abrasive wheel 10 can be of the unreinforced kind, having no internal reinforcement. FIG. 5 is a cross sectional view of unreinforced flat abrasive wheel 10. The body of unreinforced wheel 10 is fabricated by methods and from materials known to those skilled in the art.

Figure 6:
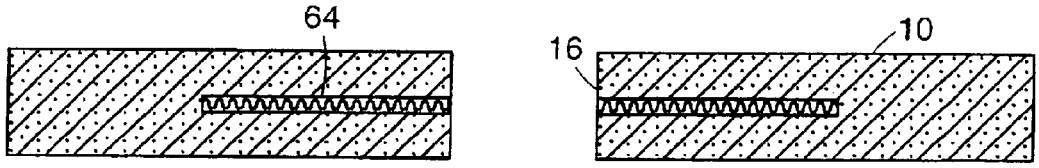
FIG. 6 is a cross-sectional view of a zone-reinforced wheel.

Alternatively, wheel 10 can be reinforced. Reinforced wheels can have (internal) fiber (cloth or oriented fiber) reinforcement throughout the full wheel diameter, plus partial (hub) reinforcement. Another flat wheel is known as Type W. It is "zone reinforced" with (internal) fiber reinforcement around the arbor hole and flange areas of the wheel (about 50% of wheel diameter). FIG. 6 is a cross sectional view of zone reinforced wheel 10 having one internal reinforcement disc 64 around arbor hole 16.

In one embodiment of the invention, flat wheel assembly 62 includes abrasive wheel 10 which has no internal reinforcement. Reinforcement layer 14 can be a triangle, square, pentagon, hexagon, octagon or can have another polygonal shape. In a preferred embodiment, reinforcement layer 14 includes fiberglass cloth. Preferably, reinforcement layer 14 has a polygonal largest diameter no greater than about 75% of the abrasive wheel diameter. In one embodiment, the polygon largest diameter is no greater than about 66% of the abrasive wheel diameter. In another embodiment of the invention, the polygon smallest diameter is at least about 50% of the abrasive wheel diameter. In still another embodiment of the invention the polygon smallest diameter is about 25% or more of said outer wheel diameter.

The invention is also related to reinforced abrasive flat wheel assemblies. In this embodiment flat wheel assembly 62 includes flat reinforced abrasive wheel 10 which has internal reinforcement. Flat wheel assembly 62 includes reinforcement layer 14 between front face 20 of abrasive wheel 10 and front flange 50. In one embodiment reinforcement layer 14 has a hexagonal shape and a hexagon largest diameter no greater than about 75% of the abrasive wheel diameter. In yet another embodiment, the largest diameter of reinforcement layer 14 is no greater than about 66% of the abrasive wheel diameter. Reinforcement layer 14 also has a hexagon smallest diameter. In one embodiment of the invention, the smallest diameter of hexagonal reinforcement layer 14 is at least about 50% of the abrasive wheel diameter. In another embodiment of the invention, the smallest diameter is at least 25% of the abrasive wheel diameter. Preferably, the reinforcement layer includes fiberglass cloth material.

Alternatively, reinforcement layer 14, positioned between front face 20 of flat reinforced abrasive wheel 10 and front flange 50, can have a pentagonal or octagonal shape. Preferably, the pentagon or octagon largest diameter is no greater than about 75% of the abrasive wheel diameter.

The invention is further described through the following example which is provided for illustrative purposes and is not intended to be limiting.

Exemplification

A Type 27, Norzon® abrasive grain, resin bonded, thin abrasive grinding wheel, of dimensions 180 mm (diameter), 7 mm (thickness) and 2.22 mm (hole diameter) was used. The performance of the wheel employing a round fiberglass cloth reinforcement layer of 125 mm in diameter was compared with the performance of the wheel employing a hexagonal fiberglass cloth reinforcement layer of 125 mm diagonal length. The bursting speed obtained with the round reinforcement layer was between 160 meter/second and 168 meter/second, with an average of 164 meter/second.

The bursting speed obtained with the hexagonal reinforcement layer was between 157 meter/second and 166 meter/second with an average of 162 meter/second.

The results indicate that the hexagonal reinforcement layer compares well with a circular reinforcement layer and performs within bursting speed industry standards which, for this type of wheel are set at around 153 meter/second.

Equivalents

Those skilled in the art will recognize, or be able to ascertain using no more than routine experimentation, many equivalents to the specific embodiments of the invention described specifically herein. Such equivalents are intended to be encompassed in the scope of the following claims.

What is claimed is:

1. An abrasive wheel assembly comprising:

(a) a flat abrasive wheel having a rear face, a front face and an outer wheel diameter, wherein the wheel is not internally reinforced;

(b) a front flange at the front face;

(c) a rear flange at the rear face; and (d) a reinforcement layer, concentric with the wheel and applied to the front flange of the wheel, wherein said reinforcement layer has a polygonal shape selected from the group consisting of triangle, pentagon, hexagon and octagon, and a polygon largest diameter that is no greater than about 75% of said outer wheel diameter.

2. The abrasive wheel assembly of claim 1, wherein the polygon smallest diameter is at least about 50% of said outer wheel diameter.

3. The abrasive wheel assembly of claim 1, wherein the polygon smallest diameter is at least about 25% of said outer wheel diameter.

4. The abrasive wheel assembly of claim 1, wherein the reinforcement layer includes fiberglass cloth.

5. The abrasive wheel assembly of claim 1, further comprising a second reinforcement layer between the rear flange and the rear face of the wheel.

6. The abrasive wheel of claim 1, wherein the polygon largest diameter is no greater than 66% of said outer wheel diameter.

7. An abrasive wheel assembly comprising:

(a) a flat internally reinforced abrasive wheel having a rear face, a front face and an outer wheel diameter;

(b) a front flange at the front face;

(c) a rear flange at the rear face; and (d) a reinforcement layer, concentric with the wheel and applied to the front face of the wheel, wherein said reinforcement layer has a hexagonal shape, and a hexagon largest diameter that is no greater than about 75% of said outer wheel diameter.

* * * * *